United States Patent [19]

Wakata

[11] Patent Number: 4,986,758

[45] Date of Patent: Jan. 22, 1991

[54] ELECTRICAL CONNECTOR

[75] Inventor: Shigekazu Wakata, Mie, Japan

[73] Assignee: Sumitomo Wiring System, Ltd., Yokkaichi, Japan

[21] Appl. No.: 313,605

[22] Filed: Feb. 22, 1989

[30] Foreign Application Priority Data

Feb. 23, 1988 [JP] Japan ..... 63-40232

[51] Int. Cl.[5] ..... H01R 13/424

[52] U.S. Cl. ..... 439/595; 439/374

[58] Field of Search ..... 439/595, 281, 282, 374, 439/592–594, 597–599, 603

[56] References Cited

U.S. PATENT DOCUMENTS

| | | | |
|---|---|---|---|
| 3,601,760 | 8/1971 | Cairns | 439/595 |
| 3,686,619 | 8/1972 | McCardell, Jr. et al. | 439/595 |
| 4,784,617 | 11/1988 | Oda | 439/595 |
| 4,797,116 | 1/1989 | Isohata et al. | 439/595 X |
| 4,826,452 | 5/1989 | Sian et al. | 439/595 |
| 4,832,613 | 5/1989 | Tsukakoshi | 439/141 |

FOREIGN PATENT DOCUMENTS

| | | |
|---|---|---|
| 3441559 | 5/1986 | Fed. Rep. of Germany . |
| 2584539 | 1/1987 | France . |
| 2115625A | 9/1983 | United Kingdom . |

*Primary Examiner*—Steven C. Bishop

*Attorney, Agent, or Firm*—Wenderoth, Lind & Ponack

[57] ABSTRACT

In the connector of the present invention, terminals are locked in their associated passages by causing projections provided near the free end of cantilever-like resilient arms in such a manner as to project inwardly of the respective passages to fit in associated recesses formed in the terminals accommodated in the passages. An individually formed fixing member is mounted over the place where the resilient arms are formed to prevent the arms from being deflected outwardly.

2 Claims, 8 Drawing Sheets

ELECTRICAL CONNECTOR

BACKGROUND OF THE INVENTION

1. Field of the Invention

The present invention relates to electrical connectors, and more particularly to an electrical connector in which terminals are fixed inside passages formed inside a connector housing by allowing a projection formed near the free end of a cantilever-like resilient arm extending into the interior of each of the passages to fit in an associated recess formed in each of the terminals accommodated in the passages, and a fixing member, which is individually constructed, is mounted over the portion where the resilient arms are formed to restrain their outward deflection once the terminals are accommodated inside the passage.

2. Statement of the Prior Art

U.S. Pat. Nos. 3,686,619 and 3,601,760 disclose conventional female connectors in which a fixing member is installed in a connector housing only after terminals are accommodated in their associated passages in the housing with the projections formed on resilient arms fitting in their associated recesses formed in the terminals.

It is currently adopted practice to manufacture different kinds of components of electrical connectors in different places, in other words, in different manufacturing lines such as housing manufacturing lines and terminal manufacturing lines and to supply components so manufactured via transporting means to assembly lines where connectors are assembled from terminals and housings.

Moreover, it is a current tendency to automatically assemble connectors from terminals and housings, i.e., automation of assembly lines.

With the above-mentioned conventional electrical connectors, since the supply of housings to assembly lines involves the supply of fixing members, control of the supply of components to assembly lines is made complicated and time-consuming.

In addition, to automatically install a fixing member into a housing in an automated assembly line, equipment is needed for guiding the fixing member to the installing position, and this causes the assembly line to be greatly scaled up.

SUMMARY OF THE INVENTION

An object of the invention is to provide an electrical connector in which a fixing member is installed in a housing before they are supplied to an assembly line, and in an assembly line a terminal is simply inserted into a passage formed in the housing, or in a case where a terminal is previously installed in a housing, a fixing member is introduced into the housing without any consideration given to the inserting direction.

Another object of the invention is to provide an electrical connector in which a fixing member additionally functions as locking means for locking an endless elastic sealing member in place in a part of a skirt overlapping portion of one of a pair of housings before the pair are brought into fitting relation, the endless elastic sealing member being provided to provide sealing engagement between the skirts formed on the respective housings so as to fit in each other when the housings are brought into connecting relationship.

A further object of the invention is to provide an electrical connector in which a fixing member additionally functions as guide means for guiding a pair of housings so as to facilitate connection of the housings.

To achieve these objects, in an electrical connector according to the present invention a temporary locking means and a means to be temporarily locked are provided on a fixing member and a connector housing to effect temporary locking of the former on the tubular portions of the latter which constitute passages for accommodating therein terminals at a position deflected from the place where resilient arms are formed.

This construction of the connector enables supply of connector housings with fixing members temporarily mounted therein to assembly lines where terminals are also brought so as to assemble connectors. The construction also makes it possible to assemble connectors simply by inserting a terminal into a fixing member containing-connector housing as the latter is supplied. The above construction further serves to facilitate fast complete insertion of a temporarily locked fixing member into a housing since the inserting direction of the fixing member has been previously defined. Thus, the connector construction of the present invention is considered to be suitable for an automated assembly line.

In addition to the above, in the connector according to the present invention, skirts are provided on each of a pair of connector housings to be fitted in each other when the housings are brought into fitting relation. In the skirt of one of the housings which receives the skirt of the other housing, one or two tubular portions are partly formed and a shelf-like projection which surrounds the tubular portion or portions is provided for an endless elastic sealing member to be placed around and to be held between the skirt of the other housing and itself. The above-mentioned fixing member is formed into a frame-like shape so as to cap the tubular portion or portions. A flange is formed at the open end of the fixing member in such a manner as to project normal to the distal end of the shelf-like portion, a seat of an endless elastic sealing member, when the fixing member is fitted over the tubular portion or portions to be placed over the place where a resilient arm or arms are formed.

In this construction of the connector, the fixing member may be utilized to function as fixing means for fixing a sealing member placed in the skirt overlapping portion to effect a sealing relation between the two skirts.

In the connector of the present invention, a plurality of tubular portions are juxtaposed to each other with a suitable space provided therebetween, and a resilient arm is formed in one of the side walls of each tubular portion in such a manner as to extend along a part of the length thereof. A guide piece is provided on the fixing member of one of a pair of housings so as to be inserted into a gap formed between the tubular portions of the other housing.

In this construction of the connector, it is possible to allow the above fixing member to function as guide means for guiding the housings when they are brought into fitting relation.

When it is temporarily fixed on the tubular portions in the housing via the temporary locking means and means to be temporarily locked, the fixing member is located at a position displaced from the place where the resilient arms are formed. The insertion of a terminal into a passage formed in each of the tubular portion is effected by bringing it into abutment with a projection formed on the free end of the resilient arm and then deflecting that free end of the arm outwardly of the tubular portion. When the terminal is inserted into a predetermined position in the passage, the projection of the resilient arm is caused to fit in a recess formed in the terminal, and this allows the resilient arm to be restored to its original position.

Thus, in this state the fixing member is completely locked with respect to the housing after it is released from the temporary locking state and is caused to move on over the resilient arm-formed portion.

Once it is completely locked and placed over the portion of the tubular portions where the resilient arms are formed, the fixing member functions to prevent the resilient arms from being deflected outwardly of the tubular portions. An endless elastic sealing member is placed around the shelf-like projection provided in the skirt of the housing before the fixing member is temporarily locked in the housing, and is supported so as to be prevented from being displaced from the shelf-like projection by a flange formed at the open end of the frame-shaped fixing member when the fixing member is completely installed in the housing.

A guide piece formed on one of a pair of connector housings is adapted to be inserted in a gap formed between the tubular portions of the other housing when the former housing and is brought into connection with the latter housing, this, in cooperation with the mutual engagement of the two skirts, serves to effect coaxial end-to-end fitting of the two connector housings.

The two terminals are brought into contact with each other only when the fitting direction of the connector housings is coaxially defined by the guide piece and the skirts.

DETAILED DESCRIPTION OF THE INVENTION

Embodiment

Figure 1:
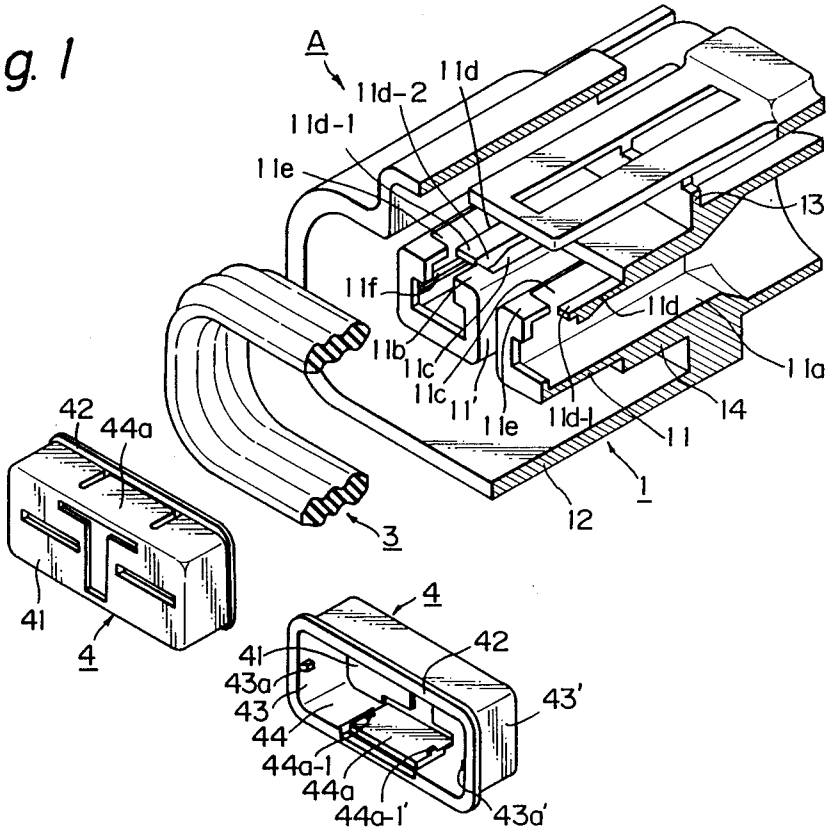
FIG. 1 is a perspective view showing a female connector housing, an elastic sealing member and a fixing member that are to be put together.
Figure 2:
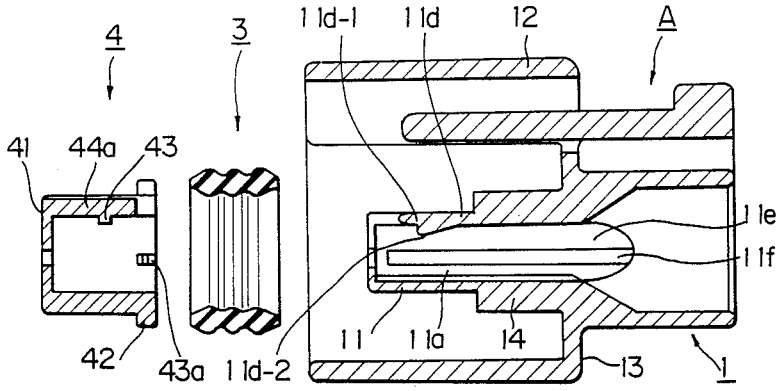
FIG. 2 is a vertical sectional view of the above components.
Figure 3:
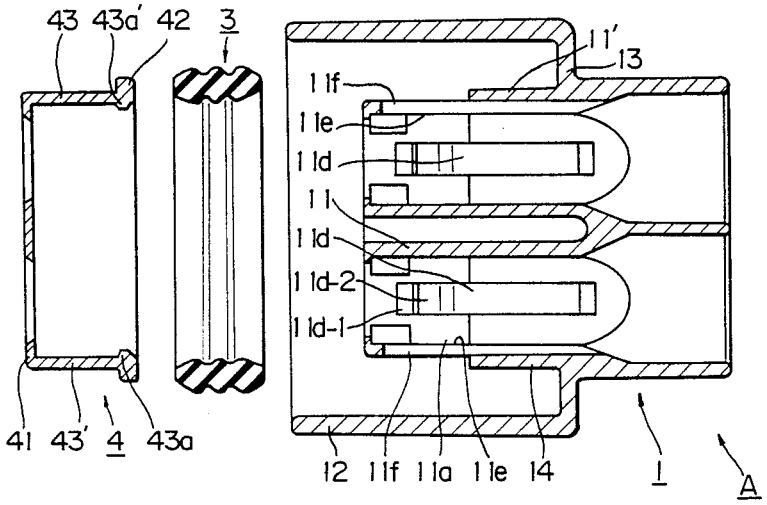
FIG. 3 is a horizontal sectional view of the same.

Referring to the accompanying drawings, a preferred embodiment of the present invention will now be described below.

A female connector A is shown in FIGS. 1 to 5, and a male connector B in FIGS. 6 to 10.

The female connector comprises a housing 1, terminal 2, an endless elastic sealing ring 3 and a fixing member 4. The housing comprises in turn a pair of tubular portions 11, 11' each having a passage 11*a* formed therein for receiving the terminal 2, a skirt 12 provided on the front half of the housing 1 in such a manner as to surround the tubular portions with a suitable space formed therebetween, a vertical wall 13 caused to extend vertically from the tubular portions at a longitudinally intermediate position thereof so as to join the rear end of the skirt 12, and a shelf-like projection 14 around which the elastic sealing ring is placed, the projection being formed in such a manner as to project forward from the position where the vertical wall intersects the pair of tubular portions at right angles so as to surround part of the tubular portions with difference in level between the side walls of the tubular portions and itself.

Provided in the side walls 11*b* of the tubular portion 11, 11' are cut-away portions 11*c* in which cantilever-like resilient arms 11*d* are formed. The tubular portions 11, 11' are juxtaposed to each other with a suitable space provided therebetween in the direction normal to the side walls 11*b* of the tubular portions.

The resilient arms 11*d* are adapted to extend in the direction in which the terminals 2 are introduced, and their distal ends 11*d*-1 are made free. A projection 11*d*-2 is formed near the free end of each of the arms in such a manner as to project inwardly of its associated passage. The projection 11*d*-2 has a vertical surface on the free end side thereof and an inclined surface on the back side. Axially elongated apertures 11*f* are formed in the outer side wall 11*e* of the respective juxtaposed tubular portions 11, 11'.

The terminal 2 is provided with a recess 21. When it is introduced into the passage 11*a* formed in the housing 1, the terminal is first brought into abutment with the projection 11*d*-2 provided near the free end 11*d*-1 of the cantilever-like resilient arm 11*d*, then caused to continue moving over the inclined surface of the projection with the free end being deflected outwardly. When the terminal reaches a predetermined position in the passage, the projection 11*d*-2 is caused to fit in the recess 21, thus making it possible to lock the terminal 2 in place.

The sealing ring 3 is placed around the shelf-like projection 14 with a suitable space provided between the skirt 12 and the sealing ring.

The fixing member 4 is something like a frame having four side walls that intersect each other at right angles and a bottom wall having a window formed therein. This frame-like fixing member is adapted to cap the pair of juxtaposed tubular portions 11, 11'. A flange 42 is provided on the open end of the fixing member 4.

Small projections 43*a*, 43*a'* are provided on a pair of side wall 43, 43' opposed to each other near the open end thereof, and cuts are made in predetermined positions on one 44 of the other pair of side walls to form a cantilever-like resilient arm 44*a* therein, and a pair of projections 44*a*-1, 44*a*-1' are provided on the interior surface of the resilient arm 44*a* at positions corresponding to the axially intermediate positions of the fixing member with a suitable space provided therebetween.

The surfaces of the small projections 43*a*, 43*a'* and projections 44*a*-1, 44*a*-1' are inclined on their sides facing the direction in which the fixing member is brought into fitting relation with the tubular portions.

Figure 4A:
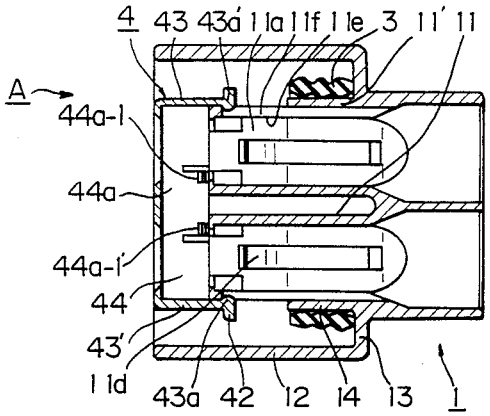
FIGS. 4(A) to (C) and FIGS. 5(A) and (B) are horizontal and vertical sectional views, respectively, illustrating the process by means of which the female connector is assembled.
Figure 4B:
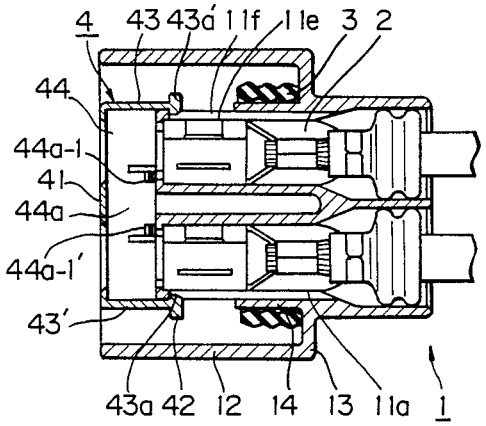
Figure 5A:
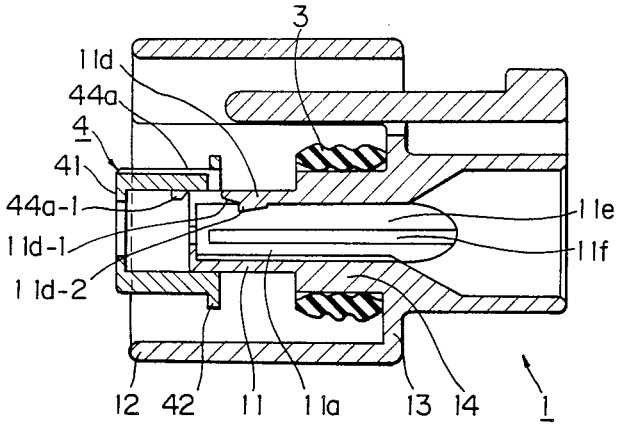

Temporary locking of the fixing member on the pair of the tubular portions 11, 11' is effected when the small projections 43*a*, 43*a'* are fitted in the elongated apertures 11*f* of the tubular portions, the projections 44*a*-1, 44*a*-1' are brought into abutment with the distal end of the side walls 11*b* of the tubular portions at the inclined surfaces thereof, and the side wall 44 of the fixing member is located at a position deflected from the place on the tubular portions 11, 11' where the resilient arms **11*d* are formed [refer to FIGS. 4(A) and 5**(A)].

Thus, it will be understood that the temporary locking means and means to be temporarily locked formed, respectively, on the fixing member and the housing of the female connector comprise the small projections **43*a*, 43*a'* formed on the interior surfaces of the side walls 43, 43' and the projections 44*a*-1, 44*a*-1' formed on the resilient piece 44*a* of the side wall 44 of the fixing member, and the distal end of the side walls 11*b* and the elongated apertures 11*f* formed in the side walls 11*e* of the tubular portions 11, 11' of the housing 1**.

Then, the terminals 2 are introduced into the passages **11*a* of the tubular portions 11, 11' in the housing 1 on which the fixing member 4 is in the temporarily locked position, and the projections 11*d*-2 of the resilient arms 11*d* are fitted in the recesses 21 of the terminals 2. The sealing ring 3 has been previously placed around the shelf-like projection 14 [refer to FIG. 4(B)]. Thus, the fixing member 4** is made ready to be completely installed in the housing, in other words, ready to be finally locked on the tubular portions in a finally locked position.

Figure 4C:
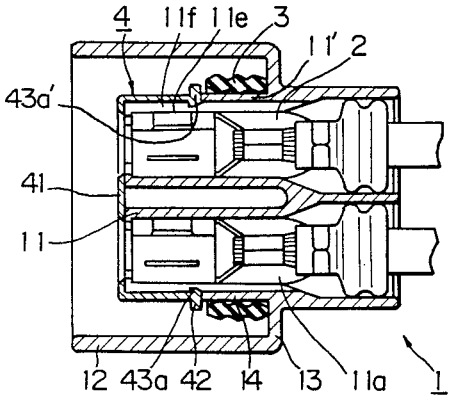
Figure 5B:
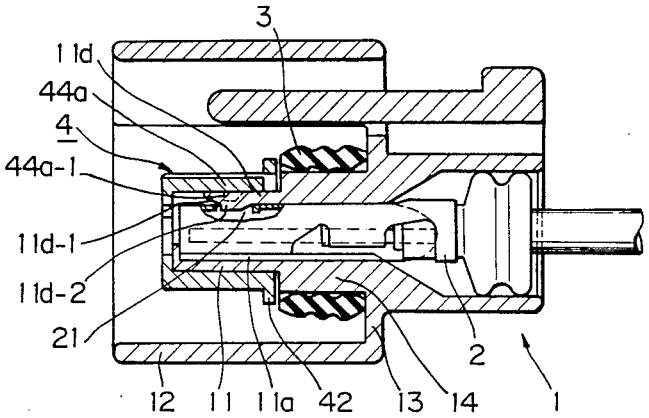
Figure 6:
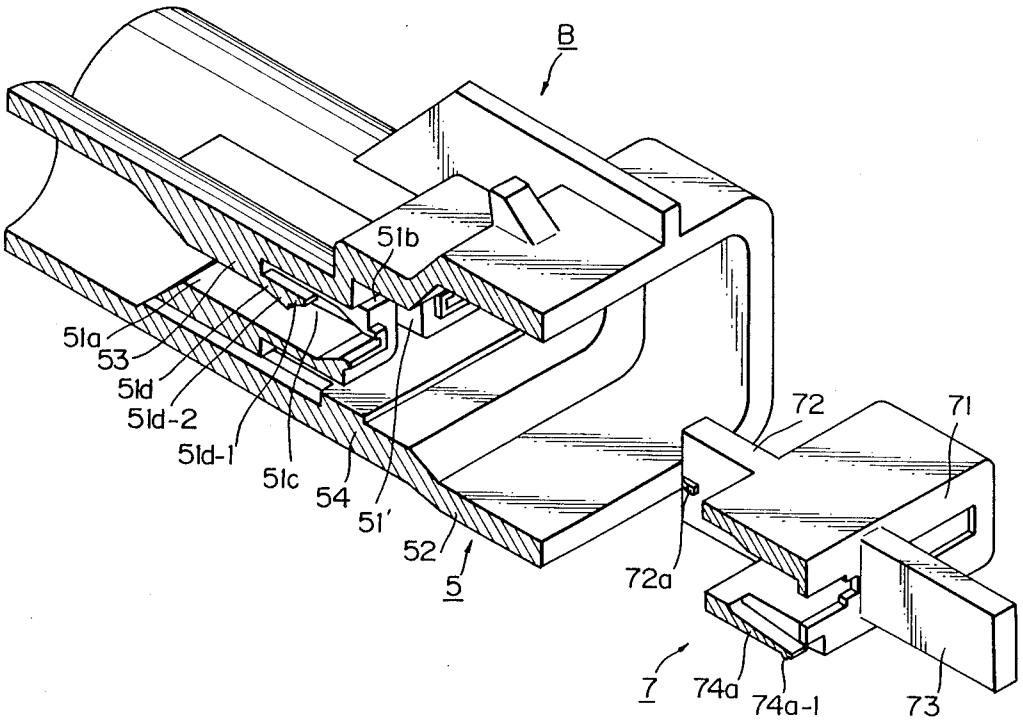
FIG. 6 is a perspective view showing a male connector housing and a fixing member that are to be put together.
Figure 7:
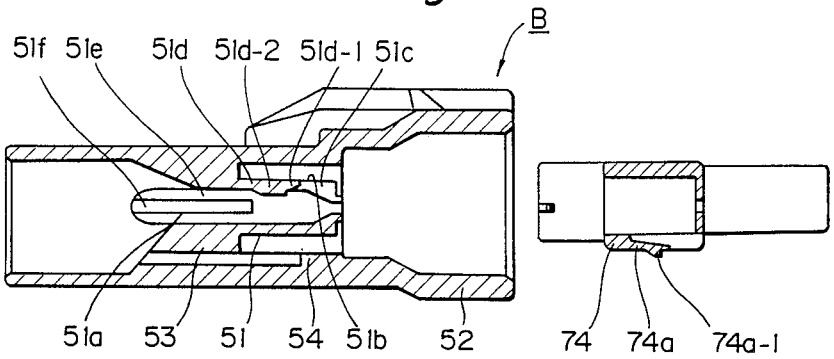
FIG. 7 is a vertical sectional view of the above components.
Figure 8:
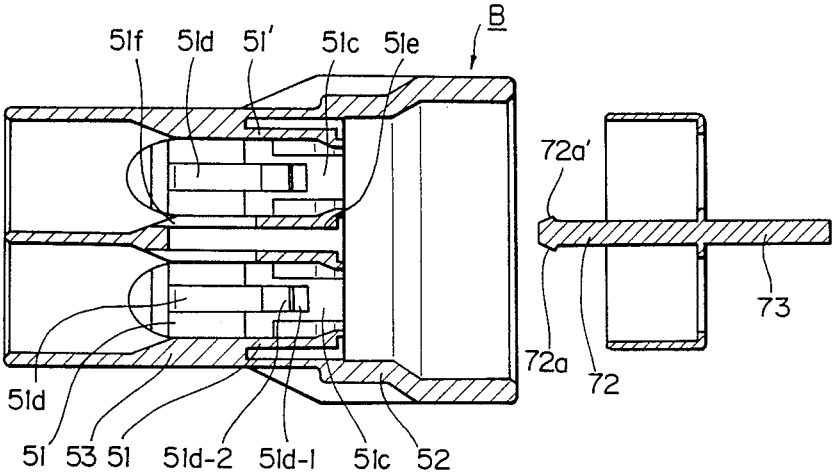
FIG. 8 is a horizontal sectional view of the same.

The movement of the fixing member to the finally locked position in the housing is effected by further pushing the fixing member 4, which is now in the temporarily locked state, against the tubular portions 11, 11' so as to cause, by utilizing the advantages of the flexibility of the resilient piece **44*a* and the inclined surfaces of the projections 44*a*-1, 44*a*-1', the projections 44*a*-1, 44*a*-1' to ride over the distal end of the side walls 11*b* to move on therealong until the bottom wall 41 of the fixing member 4 comes into abutment with the distal end of the tubular portions 11, 11', whereupon the projections 44*a*-1, 44*a*-1' are caused to fit in the cut-away portions 11*c* to be locked therein by the end of the same portion 11*c* [refer to FIGS. 4(C) and 5(B)]. The flange 42 holds sealing member 3** in position.

The male connector comprises a housing 5, terminals 6 and a fixing member 7. The housing 5 comprises in turn a pair of tubular portions 51, 51' each having a passage **51*a* for receiving the terminal 6, a skirt 52 provided on the front half of the housing 5 in such a manner as to surround the tubular portions with a suitable space provided therebetween, a vertical wall 53 caused to extend vertically from the tubular portions at a longitudinally intermediate position thereof so as to join the rear end of the skirt 52, and a portion 54 of substantially trapezoidal cross section formed on the interior surface of the skirt 52**.

Provided in the side walls 51 of the tubular portions 51, 51' are cut-away portions **51*c* in which cantilever-like resilient arms 51*d* are formed. The tubular portions 51, 51' are juxtaposed to each other with a suitable gap provided therebetween in the direction normal to the side walls 51*b*** thereof.

The resilient arms **51*d* are adapted to extend in the direction in which the terminals 6 are introduced with their distal ends made free 51*d*-1, and a projection 51*d*-2 is formed near the free end of each of the arms in such a manner as to project inwardly of its associated passage. The projection 51*d*-2 has a vertical surface on the free end side thereof and an inclined surface on the back side. Axially elongated apertures 51*f* are formed in the adjacent inner side walls 51*e* of the respective juxtaposed tubular portions 51, 51'**.

The terminal 6 is provided with a recess 61. When it is introduced into the passage **51*a* formed in the housing 5, the terminal is first brought into abutment with the projection 51*d*-2 provided near the free end 51*d*-1 of the cantilever-like resilient arm 51*d*, then caused to continue moving over the inclined surface of the projection with the free end being deflected outwardly. When the terminal is introduced to a predetermined position in the passage, the projection 51*d*-2 is caused to fit in the recess 61, thus making it possible to lock the terminal 6** in place.

The fixing member 7 is something like a frame having four side walls that intersect each other at right angles, a bottom wall 71 having a window formed therein, and a locking piece 72 and a guide piece 73 both provided at a central position of the bottom wall 71 in such a manner as to axially extend in the opposite directions. Cuts are made in predetermined positions on one of the four side walls 74 to form two cantilever-like resilient pieces **74*a* therein, and a projection 74*a*-1 is provided on each of the resilient pieces in such a manner as to project outwardly. Small projections 72*a*, 72*a'* are provided on either side of the locking piece 72 at a position near the free end thereof, the locking piece 72** being adapted to be inserted into the gap formed between the tubular portions.

The surfaces of the projections **74*a*-1 and small projections 72*a*, 72*a'*** are inclined on the sides facing the direction in which the fixing member is brought into fitting relation with the tubular portions.

Figure 9A:
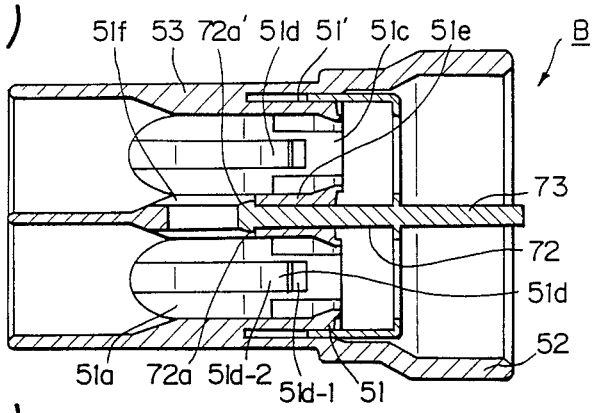
FIGS. 9(A) to (C) and FIGS. 10(A) and (B) are horizontal and vertical sectional views, respectively, illustrating the process by means of which the male connector is assembled.
Figure 9B:
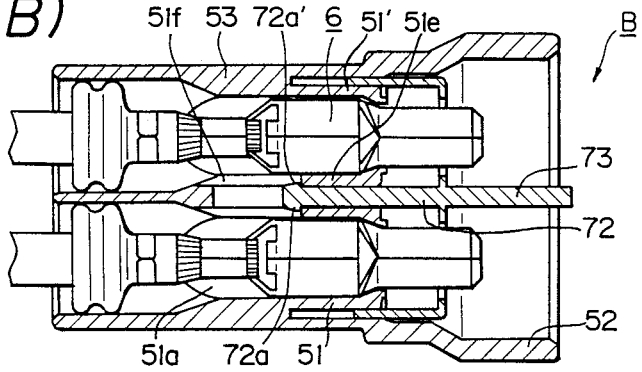
Figure 10A:
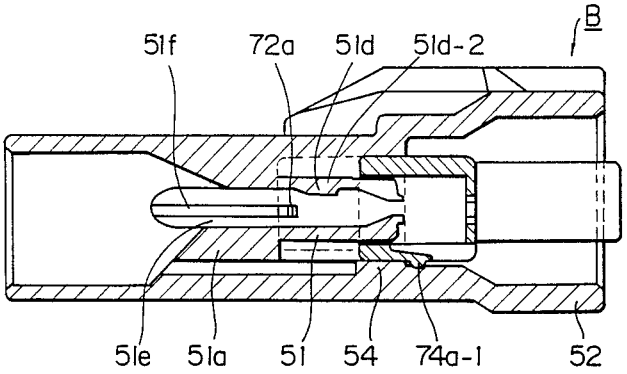
Figure 10B:
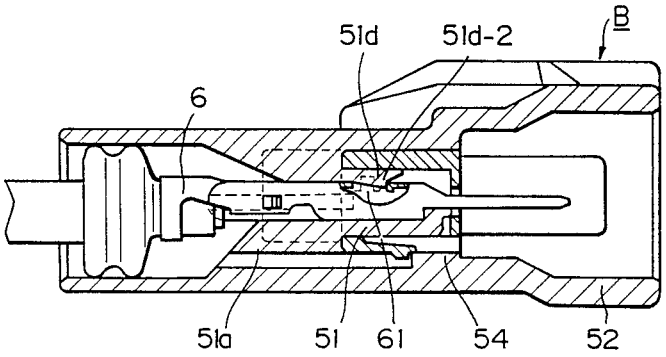

Temporary locking of the fixing member on the pair of the tubular portions 51, 51' is effected only when the small projections **72*a*, 72*a'* are fitted in the elongated apertures 51*f* of the tubular portions, the projections 74*a*-1, 74*a*-1' are brought into abutment with the portion 54 of substantially trapezoidal cross section formed on the interior surface of the skirt 52 at the inclined surfaces thereof, and the top side wall of the fixing member is located at a position deflected from the place on the tubular portions 51, 51' where the resilient arms 51*d* are formed [refer to FIGS. 9(A) and 10**(A)].

Thus, it will be understood that the temporary locking means and means to be temporarily locked formed, respectively, on the fixing member and housing of the male connector comprise the portion 54 of substantially trapezoidal cross section formed on the interior surface of the skirt 52 and the elongated apertures **51*f* formed in the adjacent inner side walls 51*e* of the juxtaposed tubular portions 51, 51' of the housing, and the small projections 72*a*, 72*a'* formed on either side of the locking piece 72 at the position near the distal end thereof and the projections 74*a*-1 formed to project outwardly of the resilient piece 74*a* of the side wall 74 of the fixing member 7**.

Then, the terminals 6 are introduced into the passages **51*a* of the tubular portions 51, 51' in the housing 5 in which the fixing member 7 is in the temporarily locked state, and the projections 51*d*-2 of the resilient arms 51*d* are fitted in the recesses 61 of the terminals 6. Thus, the fixing member 7** is made ready to be completely installed in the housing.

Figure 9C:
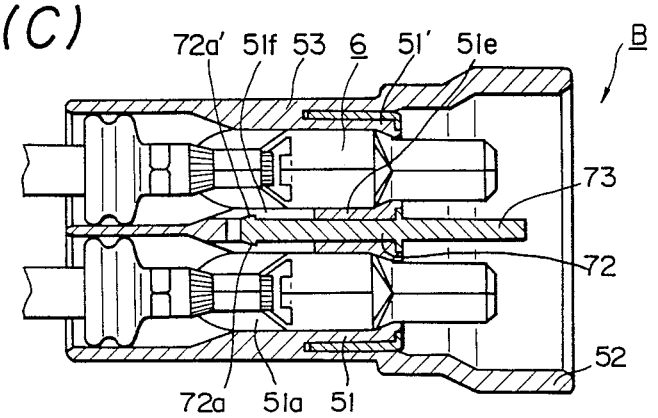

Complete installation of the fixing member in the housing is effected by further pushing the fixing member 7, which is now in the temporarily locked state, against the tubular portions 51, 51' so as to cause, by utilizing the advantages of the flexibility of the resilient pieces **74*a* and the inclined surfaces of the projections 74*a*-1, the projection 74*a*-1 to ride over the portion 54 of substantially trapezoidal cross section to move on therealong until the bottom wall 71 of the fixing member 7 comes into abutment with the distal end of the tubular portions 51, 51', whereby the projections 74a-1 are caused to be locked by the rear end of the portion 54 of substantially trapezoidal cross section [refer to FIGS. 9(C) and 10**(B)].

What is claimed is:

1. A connector comprising:

a pair of housings each having a pair of tubular portions having passages therein for having terminals introduced thereinto in one direction along the length of said passages and being accomodated in said passages, said tubular portions having cuts in one of the side walls thereof for defining cantilever-like resilient arms having projections on the free ends thereof and extending in the direction in which terminals are introduced into said passages for locking terminals in said passages by causing said projections to fit in recesses in the terminals accomodated in the passages;

a fixing member movable over the portions of said tubular portions to a finally locked position where said resilient arms are provided, said fitting means having temporary locking means thereon for temporarily locking said fixing member onto said tubular portions at a temporarily locked position spaced from the portions of the side wall of said tubular portions where said resilient arms are provided, said tubular portions in one of said housings being parallel to each other and spaced in a direction normal to the side walls to form a gap therebetween, and said fixing member on the tubular portions of the other of said housings further having a guide piece thereon projecting in a direction away from said other housing and fittable into said gap, whereby when said connector is assembled by moving said housings toward each other, said guide piece moves into said gap between said tubular portions on said one housing for guiding terminals in said other housing into the tubular portions of said one housing, and at the same time said fixing member on the tubular portions of said other housing is moved onto said tubular portions of said other housing from the temporarily locked position to the finally locked position thereof.

2. A connector as claimed in claim 1 in which said tubular portions on said other of said housings are also parallel to and spaced from each other and have a gap therebetween, and said fixing member on the tubular portions in said other of said housings has a further guide piece projecting in the opposite direction from said firstmentioned guide piece and fittable into the gap between the tubular portions of said other of said housings for guiding said fixing member onto said tubular portions from the temporarily locked position to the finally locked position during assembly of said connector.

* * * * *